US006904738B2

(12) United States Patent
Spatafora et al.

(10) Patent No.: US 6,904,738 B2
(45) Date of Patent: Jun. 14, 2005

(54) METHOD AND UNIT FOR PACKING GROUPS OF PRODUCTS

(75) Inventors: Mario Spatafora, Bologna (IT); Alver Tacchi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/849,488

(22) Filed: May 19, 2004

(65) Prior Publication Data

US 2005/0005580 A1 Jan. 13, 2005

(30) Foreign Application Priority Data

May 22, 2003 (IT) ..... BO2003A0317

(51) Int. Cl.[7] ..... B65B 11/00
(52) U.S. Cl. ..... 53/466; 53/228; 53/234
(58) Field of Search ..... 53/466, 491, 228, 53/232, 234, 170, 171

(56) References Cited

U.S. PATENT DOCUMENTS 4,617,780 A * 10/1986 Focke et al. ..... 53/466
4,887,408 A * 12/1989 Mattei et al. ..... 53/466
5,404,694 A * 4/1995 Boriani et al. ..... 53/466
5,732,533 A * 3/1998 Focke et al. ..... 53/466
6,035,612 A * 3/2000 Draghetti et al. ..... 53/466
6,085,494 A * 7/2000 Lembke et al. ..... 53/466
6,164,041 A * 12/2000 Focke et al. ..... 53/466

* cited by examiner

*Primary Examiner*—Louis Huynh
(74) *Attorney, Agent, or Firm*—Ladas & Parry LLP

(57) ABSTRACT

A method and a unit for packing groups of products, each group of products is fed together with a respective blank at a loading station to a radial first seat of a first wheel, the blank is first folded into a U and then completely folded about the group to form a packed group, the packed group is then transferred together with a sheet of overwrapping material at a transfer station to a radial second seat of a second wheel, the sheet of overwrapping material is first folded into a U and then folded completely about the packed group to form an overwrapped group; the blank and the sheet of overwrapping material both being fed successively to the same gripper associated with the first seat and fitted to the first wheel at a location downstream from the first seat.

16 Claims, 1 Drawing Sheet

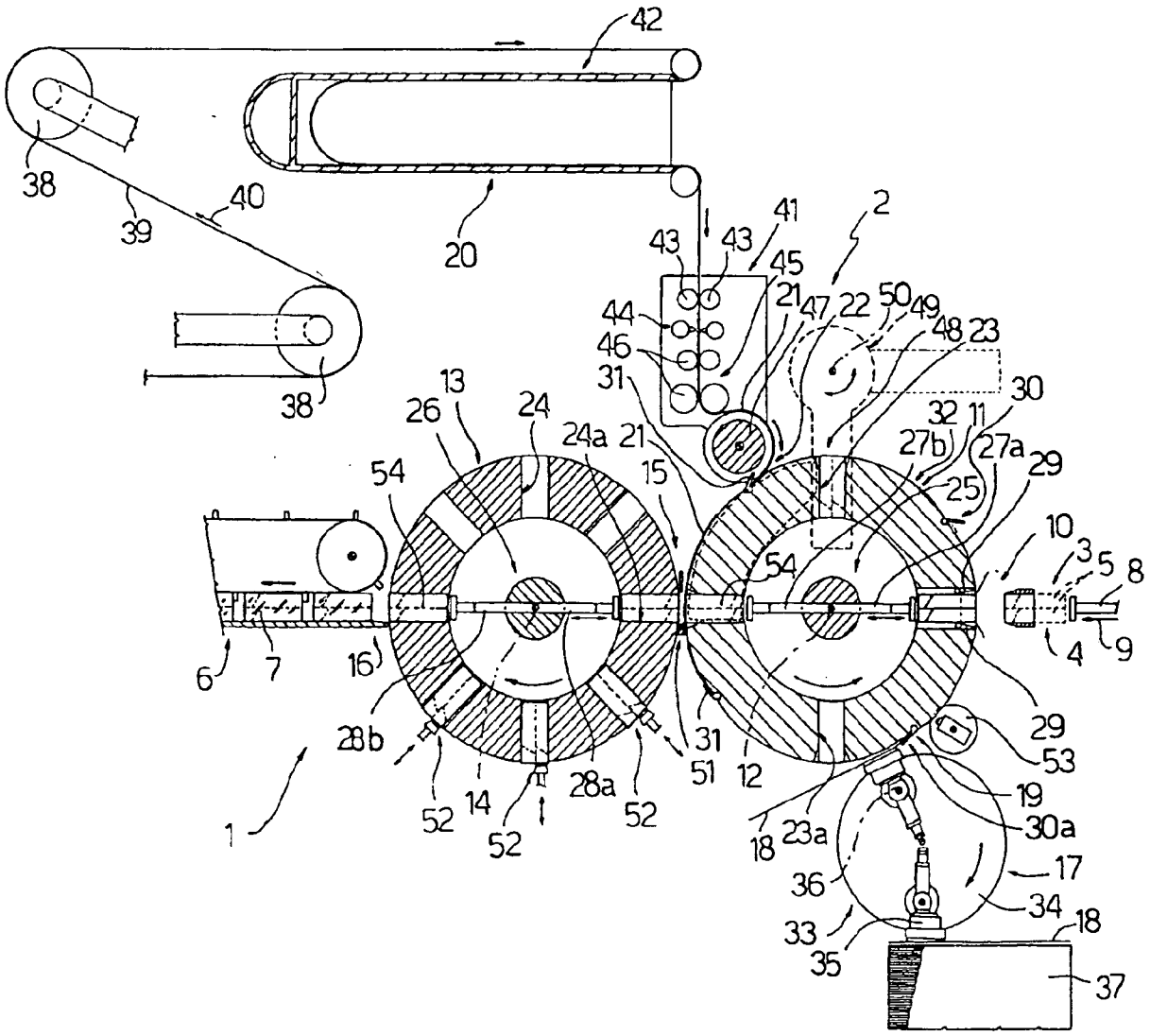
1
2
3
4
5
6
7
8
9
10
11
12
13
14
15
16
17
18
19
20
21
22
23
23a
24
24a
25
26
27a
27b
28a
28b
29
30
30a
31
32
33
34
35
36
37
38
39
40
41
42
43
44
45
46
47
48
49
50
51
52
53
54

METHOD AND UNIT FOR PACKING GROUPS OF PRODUCTS

The present invention relates to a method and unit for packing groups of products.

More specifically, the present invention relates to a method and unit for packing groups of products, of the type in which each group is fed, at a loading station, to a respective first radial seat of a first wheel, together with a relative sheet packing material element, which is first folded into a U and then completely about the relative group to obtain a packed group. This is transferred, at a transfer station, to a respective second radial seat of a second wheel, together with a relative sheet overwrapping material element, which is first folded into a U and then completely about the relative packed group to obtain an overwrapped group.

Though suitable for groups of products of any type, in particular substantially parallelepiped-shaped products, the present invention is particularly advantageous for use in the tobacco industry, and particularly on packing units of cartoning machines—to which the following description refers purely by way of example—for packing groups of packets of cigarettes in first sheet packing material elements, normally blanks of cardboard or similar, to obtain packed groups defined by cartons of packets of cigarettes, which are subsequently overwrapped in second packing material elements, normally sheets of transparent overwrapping material, to obtain overwrapped groups defined by overwrapped cartons.

BACKGROUND OF THE INVENTION

In packing units of known cartoning machines, each group of packets of cigarettes is fed to the loading station in a substantially radial direction with respect to the first wheel, and the relative blank is fed to the loading station in a direction tangent to the first wheel, is arrested in front of the relative first seat so as to close it, and is inserted inside the first seat by the relative group of packets. Similarly, each sheet of overwrapping material is fed to the transfer station in a direction substantially tangent to the first and second wheel, is arrested in front of the relative second seat so as to close it, and is inserted inside the second seat by the relative carton as this is expelled from the relative first seat into the relative second seat.

Though almost universally employed, the above packing method has several drawbacks, which increase in importance with the operating speed of the cartoning machine, and which are normally due to the difficulty encountered in controlling the position of the packing materials, as they are inserted inside the relative seats, in confined, mechanically crowded areas such as the loading and transfer stations, to which the packing materials are normally fed by gravity, and in which the blanks and sheets of overwrapping material constituting the packing materials are not normally clamped to position them accurately with respect to the relative groups as they are first inserted inside the relative seats, but are simply arrested against stops, with no possibility of preventing undesired slippage between the packing materials and the groups.

Moreover, being fed by gravity to the loading and transfer stations, the packing materials must be located over the packing units. This is not normally a problem in the case of sheets of overwrapping material, which are normally cut off massive reels, but is undoubtedly problematic in the case of blanks, which call for using an open-bottom hopper which must be fed continually with stacks of blanks.

SUMMARY OF THE INVENTION

It is an object of the present invention to provide a method of packing groups of products, designed to eliminate the aforementioned drawbacks.

According to the present invention, there is provided a method and a unit for packing groups of products, whereby each group is fed, at a loading station, to a respective radial first seat of a first wheel, together with a respective blank, which is first folded into a U and then completely about the respective group to form a packed group, which is transferred, at a transfer station, to a respective radial second seat of a second wheel, together with a respective sheet of overwrapping material, which is first folded into a U and then completely about the respective packed group to form an overwrapped group; the blank and the sheet of overwrapping material both being fed successively to a respective same gripper associated with the respective first seat and fitted to the first wheel at a location downstream from the first seat with respect to the traveling direction of the first wheel.

BRIEF DESCRIPTION OF THE DRAWING

The present invention will be described with reference to the attached drawing, which shows a partial section, with parts removed for clarity, of a preferred embodiment.

DETAILED DESCRIPTION OF THE INVENTION

Number 1 in the attached drawing indicates as a whole a packing unit of a cartoning machine 2, the packing unit receiving, at an input 3, a succession of groups 4 of packets 5 of cigarettes, and comprising an output conveyor 6 for receiving a succession of overwrapped cartons 7.

In the example shown, each group 4 forming the content of each carton 7 comprises ten packets 5 arranged in two superimposed rows, is in the form of a rectangular parallelepiped positioned with its longitudinal axis perpendicular to the attached drawing plane, and is fed to unit 1 by a pusher 8 located at a loading station 10 and acting in a substantially horizontal direction 9 parallel to the attached drawing plane.

Packing unit 1 comprises a packing wheel 11 tangent to loading station 10 and rotating anticlockwise in steps about an axis 12 perpendicular to the attached drawing plane; and an overwrapping wheel 13, which rotates clockwise in steps about an axis 14 parallel to axis 12, is tangent to packing wheel 11 at a transfer station 15 diametrically opposite loading station 10 with respect to packing wheel 11, and is tangent to the input of output conveyor 6 at an unloading station 16 diametrically opposite transfer station 15 with respect to overwrapping wheel 13.

Unit 1 also comprises a feed line 17 for feeding blanks 18 of packing material to packing wheel 11 at a feed station 19 located upstream from loading station 10 and between transfer station 15 and loading station 10 in the rotation direction of packing wheel 11; and a feed line 20 for feeding sheets 21 of overwrapping material to packing wheel 11 at a feed station 22 located downstream from loading station 10 and between loading station 10 and transfer station 15 in the rotation direction of packing wheel 11.

Wheels 11 and 13 are substantially annular wheels, which comprise respective numbers of radially through seats 23 and 24 equally spaced about respective axes 12 and 14 and each for receiving a relative group 4. More specifically, seats 23 are of even number—four in the example shown—so that, when one seat 23 is located at loading station 10, another seat 23 is located at transfer station 15. Similarly, seats 24 are also of even number—eight in the example shown—so that, when one seat 24 is located at transfer station 15, another seat 24 is located at unloading station 16.

Wheels 11 and 13 are also fitted centrally with respective push devices 25 and 26 aligned with each other and with loading station 10, transfer station 15, and unloading station 16. More specifically, push device 25, located centrally with respect to packing wheel 11, comprises two opposite, aligned, radial pushers 27*a* and 27*b*, which are movable respectively through a seat 23 at loading station 10, and a seat 23 at transfer station 15. Similarly, push device 26, located centrally with respect to overwrapping wheel 13, comprises two opposite, aligned, radial pushers 28*a* and 28*b*, which are movable respectively through a seat 24 at transfer station 15, and a seat 24 at unloading station 16.

Each seat 23 on packing wheel 11 is fitted at its outer end with a number of retaining members 29, each of which comprises, in known manner, an end tooth, and which are movable, under the control of a known cam device not shown, between an open rest position, and a closed work position in which they releasably retain a relative group 4 inside seat 23. Each seat 23 is also associated with a respective gripper 30 located downstream from seat 23 in the rotation direction of packing wheel 11, and comprising a jaw 31, which faces rearwards in the rotation direction of packing wheel 11, projects outwards with respect to a cylindrical outer surface 32 of packing wheel 11, and is rotated, under the control of a known cam device (not shown) and about a relative axis substantially coincident with a respective generating line of cylindrical surface 32, between a closed work position contacting cylindrical surface 32, and a normal open position.

Feed line 17 for supplying blanks 18 of packing material comprises a manipulator 33, in turn comprising a disk 34 rotating about an axis parallel to axis 12, and supporting a given number of pneumatic gripping heads 35, each of which is orientable with respect to disk 34 about a respective axis 36 parallel to axis 12, and is movable with disk 34 between a gripping position, in which gripping head 35 contacts the top blank 18 of packing material in a stack 37 of blanks 18 of packing material located beneath packing wheel 11, and a release position, in which gripping head 35 is located at feed station 19 to feed a front edge of the blank 18 of packing material removed off stack 37 to a gripper 30 arrested at feed station 19 with its jaw 31 in the open position.

Feed line 20 comprises a number of guide pulleys 38 for a continuous strip 39 of overwrapping material unwound off a reel (not shown) in a direction 40 by pull exerted on strip 39 by a feed unit 41 via a known well-type pneumatic tensioning device 42. Feed unit 41 comprises, in succession in direction 40, two opposite, counter-rotating traction rollers 43 engaging strip 39; a cutting assembly 44 for cutting strip 39 transversely into a succession of sheets 21 of overwrapping material; and a feed assembly 45 for feeding a sheet 21 of overwrapping material cut off strip 39 to feed station 22. In the example shown, feed assembly 45 comprises two pairs of guide rollers 46 for said sheet 21 of overwrapping material; and a suction roller 47 tangent to cylindrical surface 32 at feed station 22, and circumferentially grooved to permit passage through feed station 22 of grippers 30 in the open position.

When a seat 23 is arrested at loading station 10, the adjacent seat 23, downstream in the rotation direction of packing wheel 11, is arrested at a packing station 48 located upstream from feed station 22. At packing station 48, packing wheel 11 cooperates with a known folding device 49 which oscillates, about an axis 50, between a raised rest position, and a lowered work position in which folding device 49 performs a sequence of operations explained later on.

At transfer station 15, wheels 11 and 13 cooperate with a further known folding device 51 which comprises a movable folder and a fixed folder located on opposite sides of transfer station 15 to perform the functions described later on.

As they travel from transfer station 15 to unloading station 16, seats 24 are arrested at a succession of sealing stations 52 for performing the functions described later on.

In actual use, when an empty seat 23 is arrested at loading station 10, the gripper—hereinafter indicated 30*a*—associated with the seat 23—hereinafter indicated 23*a*—preceding it in the rotation direction of packing wheel 11 is arrested in the open position at feed station 19.

Operation of packing wheel 11 will now be described with reference to seat 23*a* and relative gripper 30*a*, as these are fed in steps to transfer station 15.

When gripper 30*a* is arrested in the open position at feed station 19, manipulator 33 is activated to withdraw a blank 18 of packing material off stack 37 and feed it to feed station 19 so that a front edge of blank 18 of packing material is inserted beneath jaw 31 of gripper 30*a*, which is then closed to clamp blank 18 of packing material to packing wheel 11 so that blank 18 of packing material projects rearwards with respect to gripper 30*a* and in front of seat 23*a*.

At this point, packing wheel 11 advances one step to feed blank 18 of packing material past and into contact with a gumming device 53, and to arrest seat 23*a*, closed outwards by blank 18 of packing material, at loading station 10. Pusher 27*a* is then moved through seat 23*a* into contact with the surface of blank 18 of packing material facing cylindrical surface 32, and pusher 8 is activated to feed a group 4 into contact with the outward-facing surface of blank 18 of packing material, so as to clamp blank 18 of packing material against pusher 27*a* and with respect to group 4, and is then moved further, together with pusher 27*a* and after gripper 30*a* is opened, to insert group 4 and blank 18 of packing material inside seat 23*a*.

Insertion of group 4 inside seat 23*a* folds blank 18 of packing material into a U about group 4, and then closes retaining members 29, which retain group 4 and relative blank 18 of packing material inside seat 23*a* and, at the same time, fold and glue, in known manner one on top of the other, two end portions of blank 18 of packing material projecting radially from seat 23*a*, to form a tubular package about group 4.

A further step forward of packing wheel 11 feeds seat 23*a* to packing station 48, and gripper 30*a*, in the open position, to feed station 22.

At packing station 48, folding device 49, initially in the raised rest position, is moved into the lowered work position to close the ends of said tubular package in known manner and form a carton 54 inside seat 23*a*. At the same time, at feed station 22, suction roller 47 feeds a front edge of a sheet 21 of overwrapping material beneath jaw 31 of gripper 30*a*, which is then closed to clamp sheet 21 of overwrapping material to packing wheel 11 so that, as packing wheel 11 advances another step to feed seat 23*a* and relative carton 54 to transfer station 15, sheet 21 of overwrapping material projects rearwards with respect to gripper 30*a* and in front of seat 23*a*.

Since each step of packing wheel 11, equal to the distance between two adjacent seats 23, corresponds to a step of overwrapping wheel 13, equal to the distance between two adjacent seats 24, and since seats 23 and 24 are synchronized at transfer station 15, seat 23*a*, on reaching transfer station 15, is arrested facing a corresponding seat 24—hereinafter indicated 24*a*—through which pusher 28*a* moves outwards into contact with the outer surface of sheet 21 of overwrapping material. Pusher 28*a* is then moved, together with pusher 27*b*, to extract carton 54 from seat 23*a* and insert it, together with sheet 21 of overwrapping material and after gripper 30*a* is opened, inside seat 24*a*, so that sheet 21 of overwrapping material is folded into a U about carton 54, with two lateral portions projecting radially from relative seat 24*a*. The two lateral portions are folded one onto the other in known manner by folding device 51 to form a tubular overwrapping about carton 54, and are sealed gradually in known manner to each other as seat 24*a* is fed in steps through sealing stations 52.

As seat 24*a* is arrested at unloading station 16, pusher 28*b* is activated to transfer carton 54 to output conveyor 6. As carton 54 and the relative tubular overwrapping are transferred and subsequently fed along an initial portion of output conveyor 6, the ends of the tubular overwrapping are closed in known manner to form an overwrapped carton 7.

In connection with the above, it should be pointed out that, by providing each seat 23 on packing wheel 11 with a respective gripper 30 located in a given position downstream from seat 23 along cylindrical surface 32, and for receiving both a relative blank 18 of packing material and a relative sheet 21 of overwrapping material, blanks 18 of packing material and sheets 21 of overwrapping material are positioned correctly at all times with respect to the relative seats, loading station 10 and transfer station 15 are greatly simplified, and stack 37 can be located in an easily accessible position beneath packing wheel 11.

What is claimed is:

1. A method of packing groups (4) of products (5), the method comprising the steps of feeding each said group (4) of products (5), at a loading station (10), to a respective first seat (23) of a first wheel (11), together with a respective sheet packing material element (18), which is first folded into a U and then completely about the respective group (4) of products (5) to form a packed group (54); and transferring said packed group (54), at a transfer station (15), to a respective second seat (24) of a second wheel (13), together with a respective overwrapping material element (21), which is first folded into a U and then completely about the respective packed group (54) to form an overwrapped group (7); the method being characterized in that the packing and overwrapping material elements (18, 21) are both fed successively to a respective same gripper (30) associated with said first seat (23) and fitted to said first wheel (11), downstream from said first seat (23) in a travelling direction of the first wheel (11).

2. A method as claimed in claim 1, wherein said first and said second wheel (11, 13) advance in steps, with respective travelling steps equal to the distance between two adjacent first seats (23) and between two adjacent second seats (24) respectively; each said first seat (23) being synchronized with a corresponding second seat (24) at said transfer station (15).

3. A method as claimed in claim 2, wherein the respective gripper (30) of each said first seat (23) is located at said first feed station (19) when the first seat (23) is located one travelling step upstream from said loading station (10).

4. A method as claimed in claim 3, wherein each said packing material element (18) is fed to said first feed station (19) by manipulating means (33), which withdraw the packing material element (18) off the top of a stack (37) of said packing material elements (18) located beneath said first wheel (11).

5. A method as claimed in claim 2, wherein each said packing material element (18) is folded completely about the respective said group (4) of products (5) as the respective said first seat (23) is arrested at a packing station (48) located downstream from said loading station (10) in said travelling direction; each said gripper (30) being located at said second feed station (22) when the respective said first seat (23) is located at said packing station (48).

6. A method as claimed in claim 1, wherein each said packing material element (18) and the respective overwrapping material element (21) are fed respectively to said first wheel (11) at a first and second feed station (19, 22) located on opposite sides of said loading station (10).

7. A method as claimed in claim 6, wherein said first feed station (19) is located downstream from said transfer station (15) and upstream from said loading station (10) in said travelling direction.

8. A method as claimed in claim 6, wherein said second feed station (22) is located downstream from said loading station (10) and upstream from said transfer station (15) in said travelling direction.

9. A unit for packing groups (4) of products (5), the unit comprising a loading station (10) for loading a succession of groups (4) of products (5); an unloading station (16) for unloading overwrapped groups (7) of products; a first wheel (11) substantially tangent to said loading station (10) and having first seats (23), each for receiving a respective said group (4) of products (5) and a respective packing material element (18) to form a respective packed group (54); a second wheel (13) substantially tangent to said unloading station (16) and having second seats (24); a transfer station (15) interposed between said first and said second wheel (11, 13), each said second seat (24) receiving a respective said packed group (54) and a respective overwrapping material element (21) at said transfer station (15), and releasing a respective said overwrapped group (7) at said unloading station (16); and feed means for gripping said packing and overwrapping material elements (18, 21) successively to said loading station (10) and said transfer station (15) respectively; the unit (1) being characterized in that said feed means (17, 20, 30) comprise, for each said first seat (23), a gripper (30) fitted to said first wheel (11) downstream from said first seat (23) in a travelling direction of the first wheel (11), and movable, with said first wheel (11), through a first and a second feed station (19, 22) for supplying said packing material element (18) and said overwrapping material element (21) from said first and second feed stations respectively.

10. A unit as claimed in claim 9, wherein said first and said second wheel (11, 13) are movable in steps, with respective travelling steps equal to the distance between two adjacent first seats (23) and between two adjacent second seats (24) respectively; each said first seat (23) being synchronized with a corresponding second seat (24) at said transfer station (15).

11. A unit as claimed in claim 9, wherein said first and said second feed station (19, 22) are located on opposite sides of said loading station (10).

12. A unit as claimed in claim 9, wherein said first feed station (19) is located downstream from said transfer station (15) and upstream from said loading station (10) in said travelling direction.

13. A unit as claimed in claim 9, wherein said first wheel (11) is so designed that the respective said gripper (30) of each said first seat (23) is located at said first feed station (19) when the first seat (23) is located one travelling step upstream from said loading station (10).

14. A unit as claimed in claim 9, wherein said feed means (17, 20, 30) comprise a feed line (17) for supplying packing material elements (18) to said first feed station (19); said feed line (17) comprising manipulating means (33) which withdraw said packing material elements (18) successively off the top of a stack (37) of said packing material elements (18) located beneath said first wheel (11).

15. A unit as claimed in claim 9, wherein said second feed station (22) is located downstream from said loading station (10) and upstream from said transfer station (15) in said travelling direction.

16. A unit as claimed in claim 9, and comprising folding means (49) associated with said first wheel (11) at a packing station (48) for folding each said packing material element (18) completely about the respective said group (4) of products (5) as the respective said first seat (23) is arrested at the packing station (48), which is located downstream from said loading station (10) in said travelling direction; each said gripper (30) being located at such a distance from the respective first seat (23) that the gripper (30) is located at said second feed station (22) when the respective said first seat (23) is located at said packing station (48).

* * * * *